US010115357B2

(12) United States Patent
Kim et al.

(10) Patent No.: US 10,115,357 B2
(45) Date of Patent: Oct. 30, 2018

(54) DISPLAY WITH SOFT-TRANSITIONING COLUMN DRIVER CIRCUITRY

(71) Applicant: Apple Inc., Cupertino, CA (US)

(72) Inventors: Taesung Kim, Los Altos, CA (US); Adam Adjiwibawa, San Jose, CA (US)

(73) Assignee: Apple Inc., Cupertino, CA (US)

( * ) Notice: Subject to any disclaimer, the term of this patent is extended or adjusted under 35 U.S.C. 154(b) by 706 days.

(21) Appl. No.: 13/718,116

(22) Filed: Dec. 18, 2012

(65) Prior Publication Data

US 2014/0168047 A1 Jun. 19, 2014

(51) Int. Cl.
*G09G 3/36* (2006.01)

(52) U.S. Cl.
CPC ..... *G09G 3/3648* (2013.01); *G09G 3/3688* (2013.01); *G09G 3/3696* (2013.01); *G09G 2330/026* (2013.01); *G09G 2330/027* (2013.01)

(58) Field of Classification Search
CPC .... G09G 3/36; G09G 3/3611; G09G 2310/08; G09G 2330/026; G09G 2330/027
USPC ..... 345/100
See application file for complete search history.

(56) References Cited

U.S. PATENT DOCUMENTS

RE39,236 E 8/2006 Imamura
7,193,598 B2 3/2007 Huang
7,633,476 B2 12/2009 Sakaguchi
2005/0017965 A1* 1/2005 Morita ..... G06F 1/263 345/211
2005/0024316 A1* 2/2005 Ohta ..... G09G 3/3688 345/100
2006/0227078 A1* 10/2006 Shino ..... G09G 3/2092 345/75.2
2007/0024553 A1* 2/2007 Araki et al. ..... 345/87
2008/0010475 A1* 1/2008 Morita ..... G06F 1/263 713/300
2008/0084371 A1* 4/2008 Yang et al. ..... 345/87
2008/0165212 A1* 7/2008 Morita ..... 345/690
2009/0033759 A1 2/2009 Wakabayashi
2011/0102405 A1 5/2011 Harada
2011/0140521 A1* 6/2011 Peron ..... H02M 3/1588 307/31

* cited by examiner

*Primary Examiner* — Afroza Chowdhury

(57) ABSTRACT

An electronic device may have a display that has column driver circuitry for providing data line signals to data lines in an array of display pixels. Gate line signals on gate lines in the array and the data line signals may be used in controlling the array to display images for a user of the electronic device. The column driver circuitry may include voltage divider circuitry such as a chain of resistors with reference voltage nodes. The nodes may be provided with reference voltages from corresponding input pins. During normal operation of the column driver circuitry, a voltage supply may supply a set of column driver voltage divider reference voltages to the input pins. During power state transitions when power supply lines for the column driver circuitry might be subjected to undesirable current surges, the voltage supply may be used in supplying transitional voltages to the input pins.

21 Claims, 13 Drawing Sheets

DISPLAY WITH SOFT-TRANSITIONING COLUMN DRIVER CIRCUITRY

BACKGROUND

This relates generally to electronic devices, and more particularly, to electronic devices with displays.

Electronic devices often include displays. For example, cellular telephones and portable computers often include displays for presenting information to a user.

Liquid crystal displays contain a layer of liquid crystal material. Display pixels in a liquid crystal display contain thin-film transistors and electrodes for applying electric fields to the liquid crystal material. The strength of the electric field in a display pixel controls the polarization state of the liquid crystal material and thereby adjusts the brightness of the display pixel.

The display pixels in a liquid crystal display are controlled using gate lines and data lines. Analog data signals are supplied to data lines running along columns of display pixels while gate line signals are asserted in succession in the rows of the display. Column driver circuitry is used in driving the analog data signals onto the data lines.

If care is not taken, displays can be subjected to large in-rush currents during power up. The in-rush currents arise when numerous columns driver circuits draw start-up current at the same time. Current surges may also affect column driver circuits during power-down operations. Particularly in configurations in which column drivers are mounted on a glass display substrate, power supply traces for the column drivers may have non-negligible impedances. As a result, the power supply rails for the column driver circuits may be subjected to undesirable ground bouncing and positive power supply drooping effects that can lead to circuit failures during power state transitions.

It would therefore be desirable to be able to provide improved ways to power up display circuitry in an electronic device.

SUMMARY

An electronic device may have a display such as a liquid crystal display. The display may have an array of display pixels having data lines and gates lines. The display may have column driver circuitry for providing data line signals to the data lines. Gate line signals on the gate lines in the array and the data line signals may be used in controlling the array of display pixels to display images for a user of the electronic device.

The column driver circuitry may include voltage divider circuitry such as a chain of resistors. The voltage divider circuitry and associated multiplexer circuitry may form part of a digital-to-analog converter for the column driver circuitry. Reference voltages may be distributed to nodes interspersed among the resistors in the chain of resistors from corresponding input pins.

During normal operation of the column driver circuitry and the display, a voltage supply may supply a set of column driver voltage divider reference voltages to the input pins. The column driver voltage divider reference voltages may be used by the voltage divider in the digital-to-analog converter to produce data line signals in response to digital data received at a digital data port in the column driver circuitry.

During power state transitions when the power supply lines for the column driver circuitry might be subjected to undesirable current surges, the voltage supply may be used in supplying transitional voltages to the input pins. The transitional voltages may include time-varying voltages or a shared fixed voltage such as a common electrode voltage from the array of display pixels may be applied. By using transitional voltages during power state transitions, current surges can be minimized.

Further features of the invention, its nature and various advantages will be more apparent from the accompanying drawings and the following detailed description of the preferred embodiments.

DETAILED DESCRIPTION

Electronic devices may include displays. The displays may be used to display images to a user. Illustrative electronic devices that may be provided with displays are shown in FIGS. 1, 2, 3, and 4.

Figure 1:
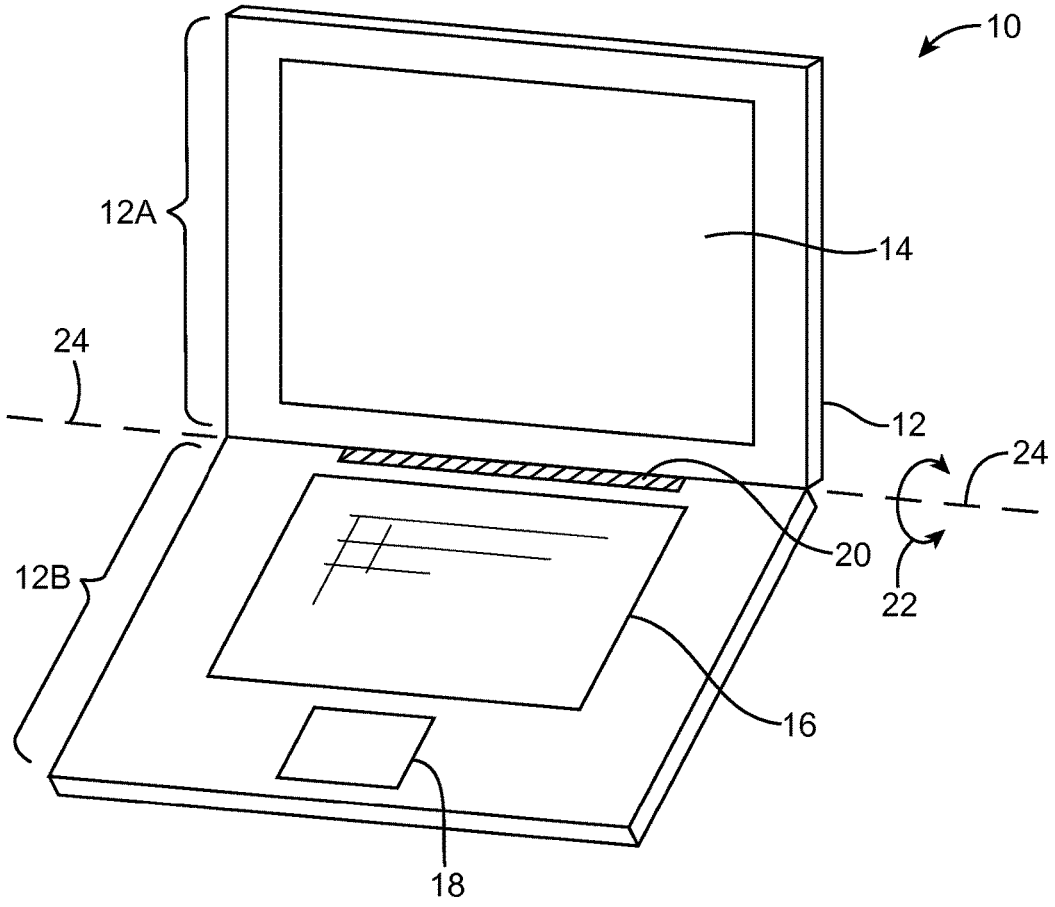
FIG. 1 is a perspective view of an illustrative electronic device such as a laptop computer with a display in accordance with an embodiment of the present invention.

FIG. 1 shows how electronic device 10 may have the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes referred to as a display housing or lid, may be placed in a closed position by rotating upper housing 12A towards lower housing 12B about rotational axis 24.

Figure 2:
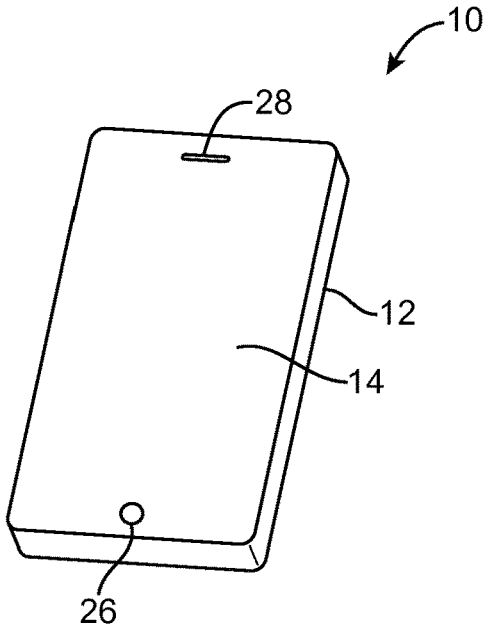
FIG. 2 is a perspective view of an illustrative electronic device such as a handheld electronic device with a display in accordance with an embodiment of the present invention.

FIG. 2 shows how electronic device 10 may be a handheld device such as a cellular telephone, music player, gaming device, navigation unit, or other compact device. In this type of configuration for device 10, housing 12 may have opposing front and rear surfaces. Display 14 may be mounted on a front face of housing 12. Display 14 may, if desired, have openings for components such as button 26. Openings may also be formed in display 14 to accommodate a speaker port (see, e.g., speaker port 28 of FIG. 2).

Figure 3:
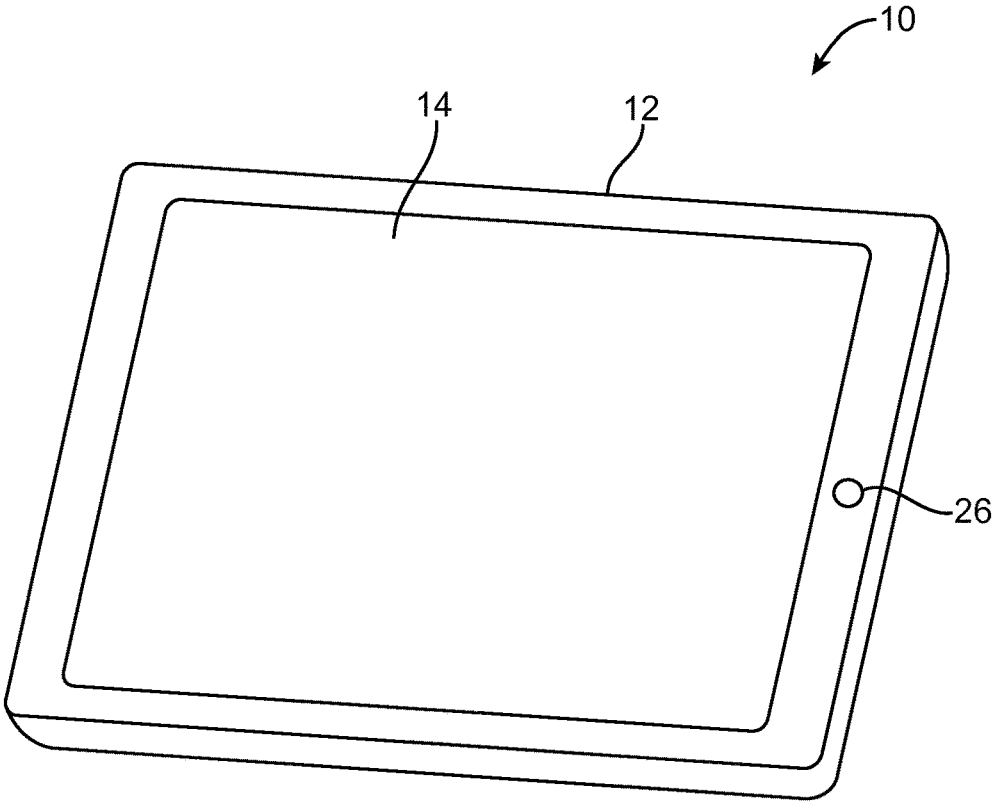
FIG. 3 is a perspective view of an illustrative electronic device such as a tablet computer with a display in accordance with an embodiment of the present invention.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have an opening to accommodate button 26 (as an example).

Figure 4:
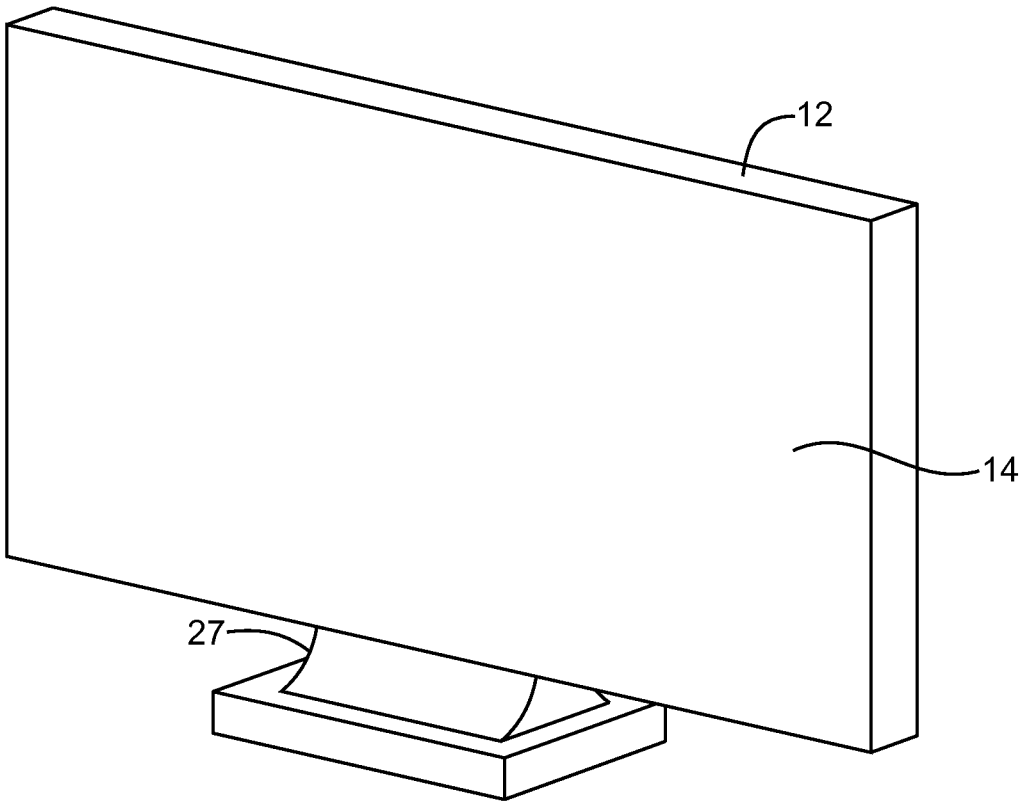
FIG. 4 is a perspective view of an illustrative electronic device such as a computer display with display structures in accordance with an embodiment of the present invention.

FIG. 4 shows how electronic device 10 may be a computer display or a computer that has been integrated into a computer display. With this type of arrangement, housing 12 for device 10 may be mounted on a support structure such as stand 27. Display 14 may be mounted on a front face of housing 12.

The illustrative configurations for device 10 that are shown in FIGS. 1, 2, 3, and 4 are merely illustrative. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Display 14 for device 10 may include display pixels formed from liquid crystal display (LCD) components or other suitable image pixel structures.

A display cover layer may cover the surface of display 14 or a display layer such as a color filter layer or other portion of a display may be used as the outermost (or nearly outermost) layer in display 14. The outermost display layer may be formed from a transparent glass sheet, a clear plastic layer, or other transparent member.

Figure 5:
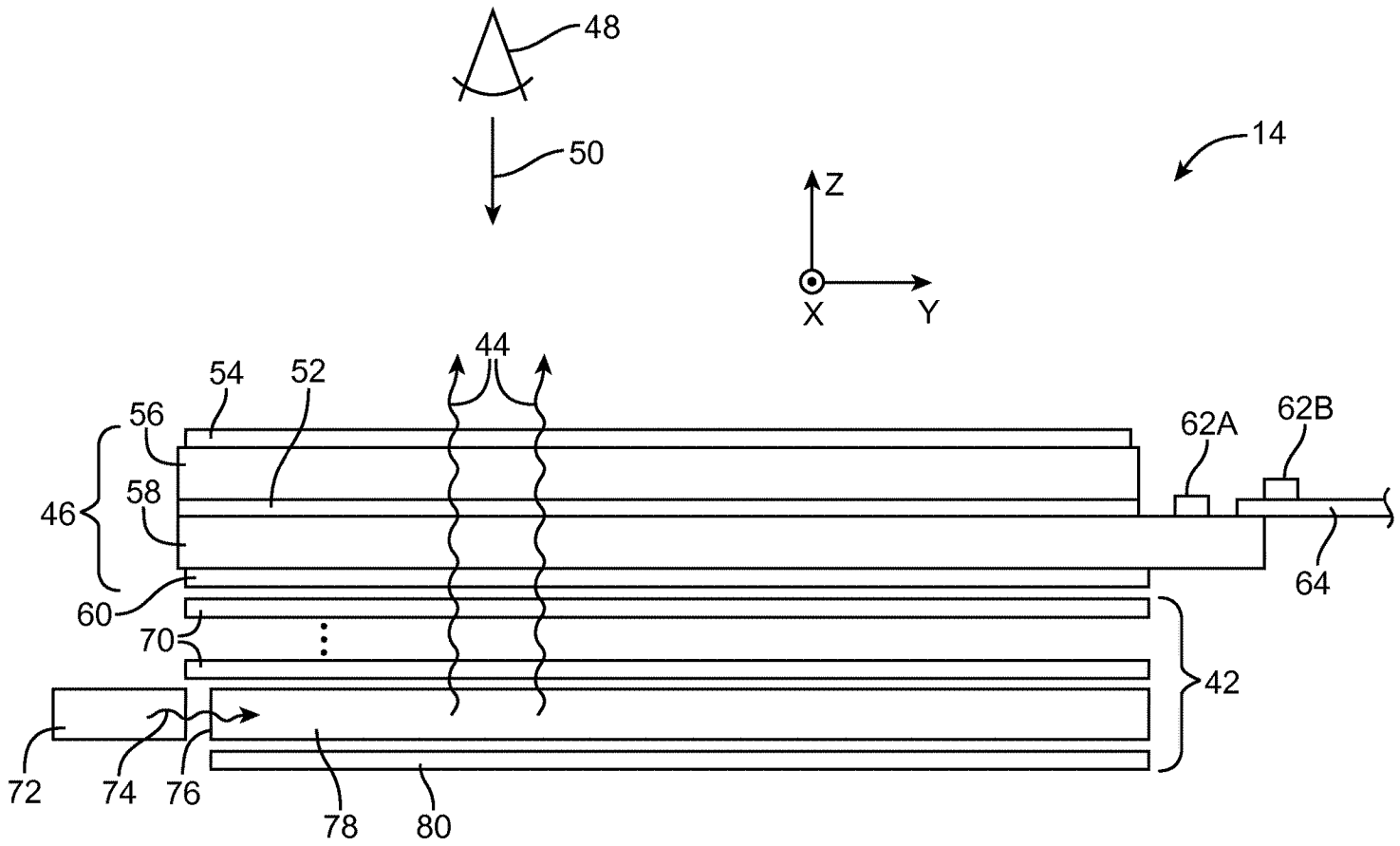
FIG. 5 is a cross-sectional side view of an illustrative display in accordance with an embodiment of the present invention.

A cross-sectional side view of an illustrative configuration for display 14 of device 10 (e.g., for display 14 of the devices of FIG. 1, FIG. 2, FIG. 3, FIG. 4 or other suitable electronic devices) is shown in FIG. 5. As shown in FIG. 5, display 14 may include backlight structures such as backlight unit 42 for producing backlight 44. During operation, backlight 44 travels outwards (vertically upwards in dimension Z in the orientation of FIG. 5) and passes through display pixel structures in display layers 46. This illuminates any images that are being produced by the display pixels for viewing by a user. For example, backlight 44 may illuminate images on display layers 46 that are being viewed by viewer 48 in direction 50.

Display layers 46 may be mounted in chassis structures such as a plastic chassis structure and/or a metal chassis structure to form a display module for mounting in housing 12 or display layers 46 may be mounted directly in housing 12 (e.g., by stacking display layers 46 into a recessed portion in housing 12). Display layers 46 may form a liquid crystal display or may be used in forming displays of other types.

In a configuration in which display layers 46 are used in forming a liquid crystal display, display layers 46 may include a liquid crystal layer such a liquid crystal layer 52. Liquid crystal layer 52 may be sandwiched between display layers such as display layers 58 and 56. Layers 56 and 58 may be interposed between lower polarizer layer 60 and upper polarizer layer 54.

Layers 58 and 56 may be formed from transparent substrate layers such as clear layers of glass or plastic. Layers 56 and 58 may be layers such as a thin-film transistor layer and/or a color filter layer. Conductive traces, color filter elements, transistors, and other circuits and structures may be formed on the substrates of layers 58 and 56 (e.g., to form a thin-film transistor layer and/or a color filter layer). Touch sensor electrodes may also be incorporated into layers such as layers 58 and 56 and/or touch sensor electrodes may be formed on other substrates.

With one illustrative configuration, layer 58 may be a thin-film transistor layer that includes an array of thin-film transistors and associated electrodes (display pixel electrodes) for applying electric fields to liquid crystal layer 52 and thereby displaying images on display 14. Layer 56 may be a color filter layer that includes an array of color filter elements for providing display 14 with the ability to display color images. If desired, layer 58 may be a color filter layer and layer 56 may be a thin-film transistor layer.

During operation of display 14 in device 10, control circuitry (e.g., one or more integrated circuits on a printed circuit) may be used to generate information to be displayed on display 14 (e.g., display data). The information to be displayed may be conveyed to one or more display driver integrated circuits such as circuit 62A or circuit 62B using a signal path such as a signal path formed from conductive metal traces in a rigid or flexible printed circuit such as printed circuit 64 (as an example).

Backlight structures 42 may include a light guide plate such as light guide plate 78. Light guide plate 78 may be formed from a transparent material such as clear glass or plastic. During operation of backlight structures 42, a light source such as light source 72 may generate light 74. Light source 72 may be, for example, an array of light-emitting diodes.

Light 74 from light source 72 may be coupled into edge surface 76 of light guide plate 78 and may be distributed in dimensions X and Y throughout light guide plate 78 due to the principal of total internal reflection. Light guide plate 78 may include light-scattering features such as pits or bumps. The light-scattering features may be located on an upper surface and/or on an opposing lower surface of light guide plate 78.

Light 74 that scatters upwards in direction Z from light guide plate 78 may serve as backlight 44 for display 14. Light 74 that scatters downwards may be reflected back in the upwards direction by reflector 80. Reflector 80 may be formed from a reflective material such as a layer of white plastic or other shiny materials.

To enhance backlight performance for backlight structures 42, backlight structures 42 may include optical films 70. Optical films 70 may include diffuser layers for helping to homogenize backlight 44 and thereby reduce hotspots, compensation films for enhancing off-axis viewing, and brightness enhancement films (also sometimes referred to as turning films) for collimating backlight 44. Optical films 70 may overlap the other structures in backlight unit 42 such as light guide plate 78 and reflector 80. For example, if light guide plate 78 has a rectangular footprint in the X-Y plane of FIG. 5, optical films 70 and reflector 80 may have a matching rectangular footprint.

Figure 6:
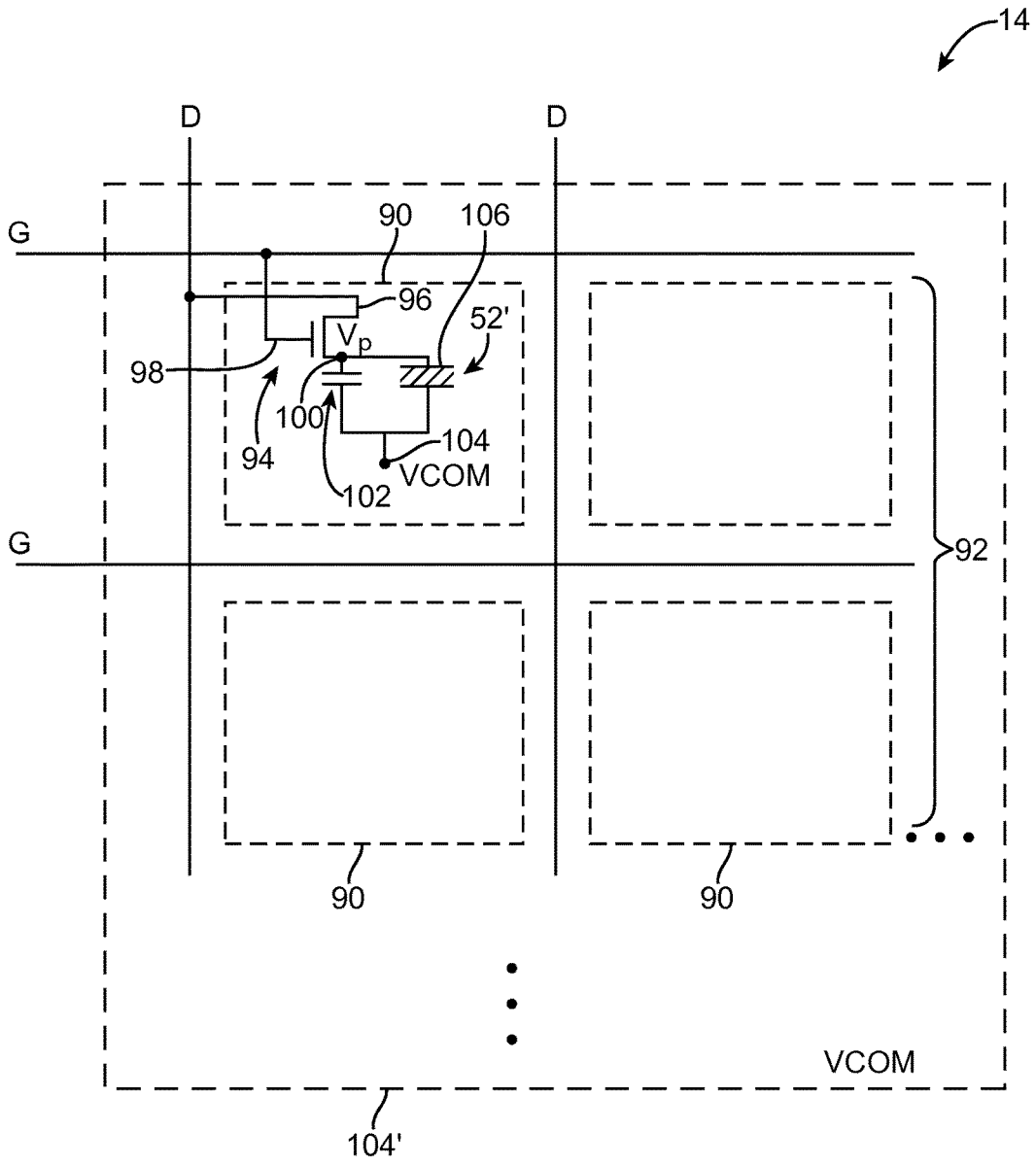
FIG. 6 is a top view of an array of display pixels in a display in accordance with an embodiment of the present invention.

As shown in FIG. 6, display 14 may include a pixel array such as pixel array 92. Pixel array 92 may contain rows and columns of display pixels 90. The circuitry of pixel array 92 may be controlled using signals such as data line signals on data lines D and gate line signals on gate lines G.

Pixels 90 in pixel array 92 may contain thin-film transistor circuitry (e.g., polysilicon transistor circuitry or amorphous silicon transistor circuitry) and associated structures for producing electric fields across liquid crystal layer 52 in display 14. Each display pixel may have a respective thin-film transistor such as thin-film transistor 94 to control the application of electric fields to a respective pixel-sized portion 52' of liquid crystal layer 52.

The thin-film transistor structures that are used in forming pixels 90 may be located on a thin-film transistor substrate such as a layer of glass. The thin-film transistor substrate and the structures of display pixels 90 that are formed on the surface of the thin-film transistor substrate collectively form thin-film transistor layer 58 (FIG. 5).

Gate driver circuitry may be used to generate gate signals on gate lines G. The gate driver circuitry may be formed from thin-film transistors on the thin-film transistor layer or may be implemented in separate integrated circuits. Gate driver circuitry may be located on both the left and right sides of pixel array 92 or on one side of pixel array 92 (as examples).

The data line signals on data lines D in pixel array 92 carry analog image data (e.g., voltages with magnitudes representing pixel brightness levels). During the process of displaying images on display 14, digital data from a microprocessor or other storage and processing circuitry and may be converted into corresponding analog data signals. The analog data signals may be provided to data lines D.

The data line signals on data lines D are distributed to the columns of display pixels 90 in pixel array 92 by column driver circuitry such as one or more column driver integrated circuits (sometimes referred to as source drivers, display driver circuits, or data line driver circuitry). Gate line signals on gate lines G are provided to the rows of pixels 90 in pixel array 92 by associated gate driver circuitry.

The circuitry of display 14 such as the circuitry of pixels 90 may be formed from conductive structures (e.g., metal lines and/or structures formed from transparent conductive materials such as indium tin oxide) and may include transistors such as transistor 94 that are fabricated on the thin-film transistor substrate layer of display 14. The thin-film transistors may be, for example, polysilicon thin-film transistors or amorphous silicon transistors.

As shown in FIG. 6, pixels such as pixel 90 may be located at the intersection of each gate line G and data line D in array 92. A data signal on each data line D may be supplied to terminal 96 from one of data lines D. Thin-film transistor 94 (e.g., a thin-film polysilicon transistor or an amorphous silicon transistor) may have a gate terminal such as gate 98 that receives gate line control signals on gate line signal path G. When a gate line control signal is asserted, transistor 94 will be turned on and the data signal at terminal 96 will be passed to node 100 as voltage Vp. Data for display 14 may be displayed in frames. Following assertion of the gate line signal in each row to pass data signals to the pixels of that row, the gate line signal may be deasserted. In a subsequent display frame, the gate line signal for each row may again be asserted to turn on transistor 94 and capture new values of Vp.

Pixel 90 may have a signal storage element such as capacitor 102 or other charge storage element. Storage capacitor 102 may be used to store signal Vp in pixel 90 between frames (i.e., in the period of time between the assertion of successive gate signals).

Display 14 may have a common electrode coupled to node 104. The common electrode (which is sometimes referred to as the Vcom electrode) may be used to distribute a common electrode voltage such as common electrode voltage Vcom to nodes such as node 104 in each pixel 90 of array 92. As shown by illustrative electrode pattern 104' of FIG. 6, Vcom electrode 104 may be implemented using a blanket film of a transparent conductive material such as indium tin oxide (i.e., electrode 104 may be formed from a layer of indium tin oxide that covers all of pixels 90 in array 92).

In each pixel 90, capacitor 102 may be coupled between nodes 100 and 104. A parallel capacitance arises across nodes 100 and 104 due to electrode structures in pixel 90 that are used in controlling the electric field through the liquid crystal material of the pixel (liquid crystal material 52'). As shown in FIG. 6, electrode structures 106 may be coupled to node 100. The capacitance across liquid crystal material 52' is associated with the capacitance between electrode structures 106 and common electrode Vcom at node 104. During operation, electrode structures 106 may be used to apply a controlled electric field (i.e., a field having a magnitude proportional to Vp-Vcom) across pixel-sized liquid crystal material 52' in pixel 90. Due to the presence of storage capacitor 102 and the capacitance of material 52', the value of Vp (and therefore the associated electric field across liquid crystal material 52') may be maintained across nodes 106 and 104 for the duration of the frame.

The electric field that is produced across liquid crystal material 52' causes a change in the orientations of the liquid crystals in liquid crystal material 52'. This changes the polarization of light passing through liquid crystal material 52'. The change in polarization may, in conjunction with polarizers 60 and 54 of FIG. 4, be used in controlling the amount of light 44 that is transmitted through each pixel 90 in array 92 of display 14.

Figure 7:
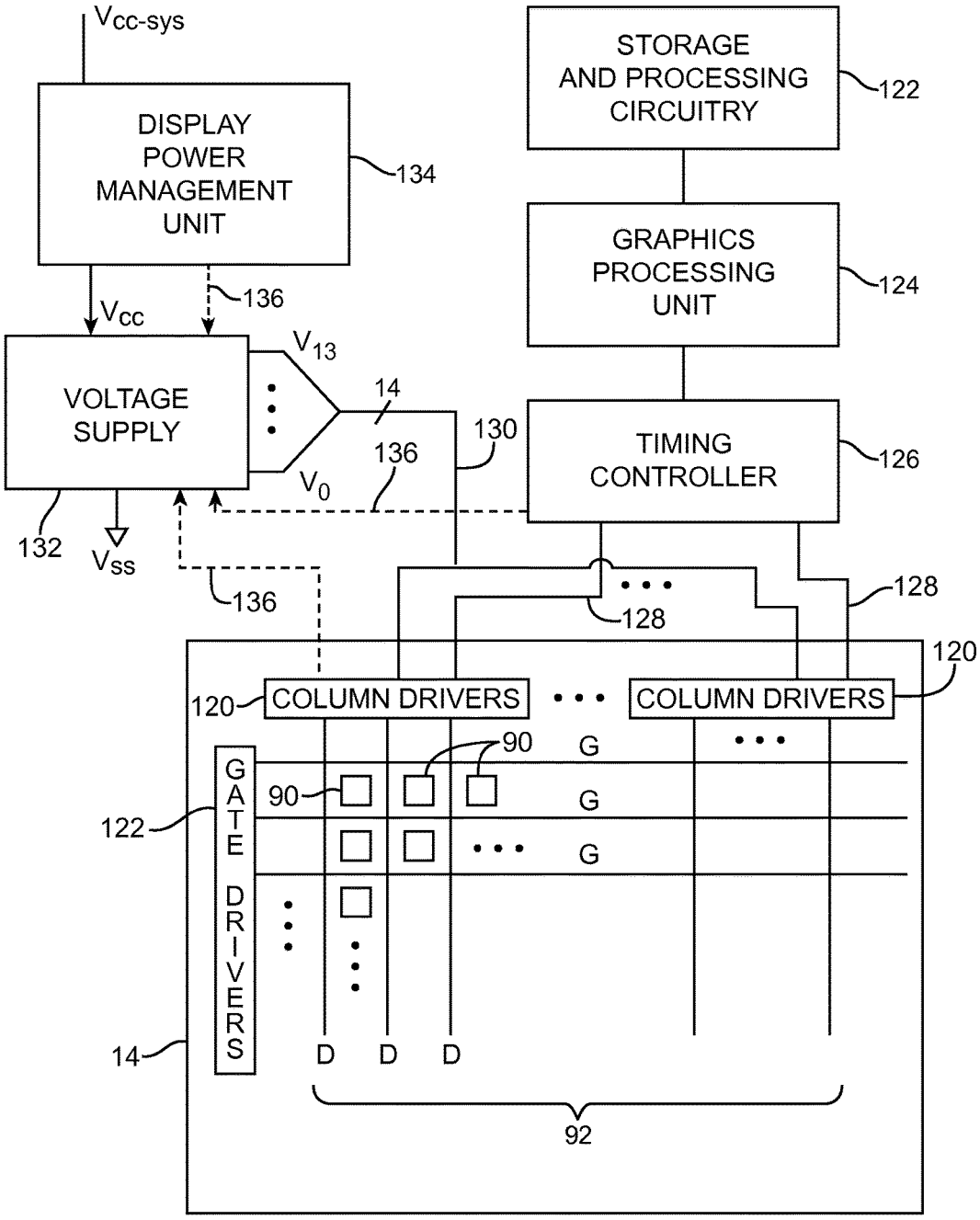
FIG. 7 is a circuit diagram of display circuitry in accordance with an embodiment of the present invention.

FIG. 7 is a circuit diagram of illustrative circuitry that may be used in displaying images for a user of device 10 on pixel array 92 of display 14. As shown in FIG. 7, display 14 may have column driver circuitry 120 that drives data signals (analog voltages) D onto the data lines of array 92. Gate driver circuitry 122 drives gate line signals onto gate lines G of array 92. Using the data lines and gate lines, display pixels 90 may be configured to display images on display 14 for a user. Gate driver circuitry 122 may be implemented using thin-film transistor circuitry on a display substrate such as a glass thin-film-transistor layer substrate or may be implemented using integrate circuits that are mounted on the display substrate or are attached to the display substrate by a flexible printed circuit or other connecting layer. Column driver circuitry 120 may be implemented using one or more column driver integrated circuits that are mounted on the display substrate or using column driver circuits mounted on other substrates.

Device 10 may include storage and processing circuitry 122. Storage and processing circuitry 122 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 122 may be used in controlling the operation of device 10. The processing circuitry may be based on a processor such as a microprocessor and other suitable integrated circuits. With one suitable arrangement, storage and processing circuitry 122 may be used to run software on device 10, such as internet browsing applications, email applications, media playback applications, operating system functions, software for capturing and processing images, software implementing functions associated with gathering and processing sensor data, software that makes adjustments to display brightness and touch sensor functionality, etc.

During operation of device 10, storage and processing circuitry 122 may produce data that is to be displayed on display 14. This display data may be provided to display control circuitry such as timing controller integrated circuit 126 using graphics processing unit 124.

Timing controller 126 may provide digital display data to column driver circuitry 120 using paths 128. Column driver circuitry 120 may receive the digital display data from timing controller 126. Using analog-to-digital converter circuitry within column driver circuitry 120, column driver circuitry 120 may provide corresponding analog output signals D on the data lines running along the columns of display pixels 90 of array 92.

The analog-to-digital converter circuitry within column driver circuitry 120 may include voltage divider circuitry based on chains of resistors. Nodes may be interspersed among the resistors. The column driver circuitry 120 may be supplied with column driver voltage divider reference voltages that are routed to selected nodes within the resistor chains. The column driver voltage divider reference voltages, which may sometimes be referred to as column driver input supply voltages may be supplied to column divider circuitry 120 on path 130 using power supply circuitry such as voltage supply 132.

There may be any suitable number of signal lines in path 130. With one suitable arrangement, which is sometimes described herein as an example, there are 14 lines in path 130, each of which is used to convey a respective reference voltage V13 . . . V0 to column driver circuitry 120. This is, however, merely illustrative. Path 130 may have more than 14 lines or fewer than 14 lines, if desired.

Display power management unit 134 may receive a system-wide power supply voltage such as Vcc-sys and may supply a corresponding output voltage Vcc for use in powering display 14 to voltage supply circuitry 132. Voltage supply circuitry 132 may also be provided with other voltages (e.g., ground voltage Vss, other positive and/or negative power supply voltages, etc.). Voltages such as voltages Vcc and Vss may be used in providing the reference voltages on path 130 to column driver circuitry 120.

Voltage supply 132 may contain control circuitry for dynamically adjusting the values of column driver reference voltages V0 . . . V13. This allows voltage supply 132 to control the time-dependent magnitude of reference voltages V0 . . . V13. By adjusting the way in which reference voltages V0 . . . V13 evolve as a function of time, display soft-start and soft-shut-down features can be implemented to limit current surges when power up and powering down column driver circuitry 120 (i.e., current surges can be limited during power state transitions for driver circuitry 120). The operation of voltage supply 132 may be controlled by circuitry within voltage supply 132 and/or using external circuits that supply control signals (e.g., control signals supplied using paths 136 from circuitry such as display power management unit 134, timing controller 126, and column driver circuitry 120).

Figure 8:
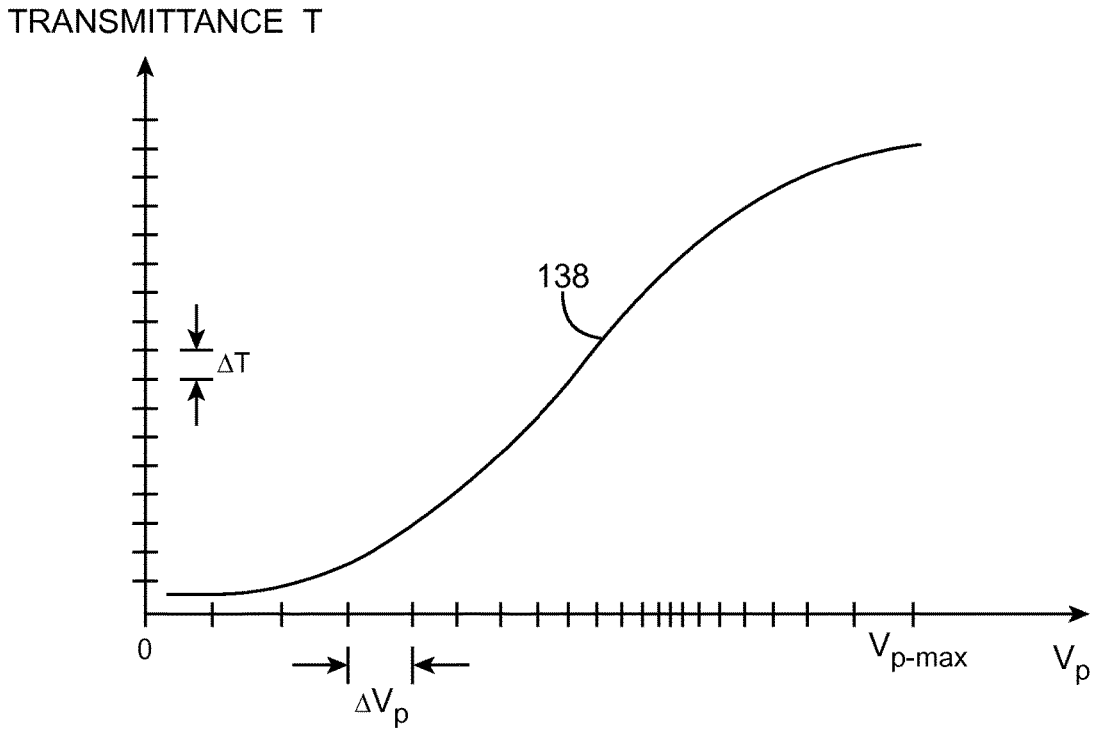
FIG. 8 is a graph of display pixel transmittance in a liquid crystal display as a function of applied electrode voltage in accordance with an embodiment of the present invention.

In the graph of FIG. 8, display pixel transmittance T has been plotted as a function of applied data line voltage Vp for an illustrative liquid crystal display. Curve 138 shows how much transmittance T is achieved for a given applied pixel voltage Vp (i.e., how much transmittance T is achieved when a given electrode voltage and corresponding electric field strength are applied across the liquid crystal material of a pixel). During operation of display 14, column driver circuitry 120 produces data signals D that give rise to Vp values between 0 and Vp-max. In order to achieve evenly sized transmittance steps ($\Delta T$) as a function of voltage step size $\Delta Vp$ and thereby provide images on display 14 with a smooth appearance, it may be desirable to use varying step sizes $\Delta Vp$ when controlling voltage Vp on display pixels 70. In an illustrative arrangement, display 14 may be adjustable to produce 256 different transmittance values T using 256 equally sized transmittance steps LT. Due to the shape of S-curve 138, the size of steps $\Delta Vp$ used to achieve these evenly spaced $\Delta T$ values varies as a function of Vp. In particular, $\Delta Vp$ is larger at low and high values of Vp than at intermediate values of Vp. Column driver circuitry 120 preferably contains digital-to-analog converter circuitry that produces Vp values of the type shown in FIG. 8 (e.g., 256 Vp values separated by $\Delta Vp$ steps of varying sizes). In general, the digital-to-analog converter circuitry of column drivers 120 may be configured to produce any suitable number of Vp values. The use of column driver circuitry that produces 256 different Vp values is merely illustrative.

Figure 9:
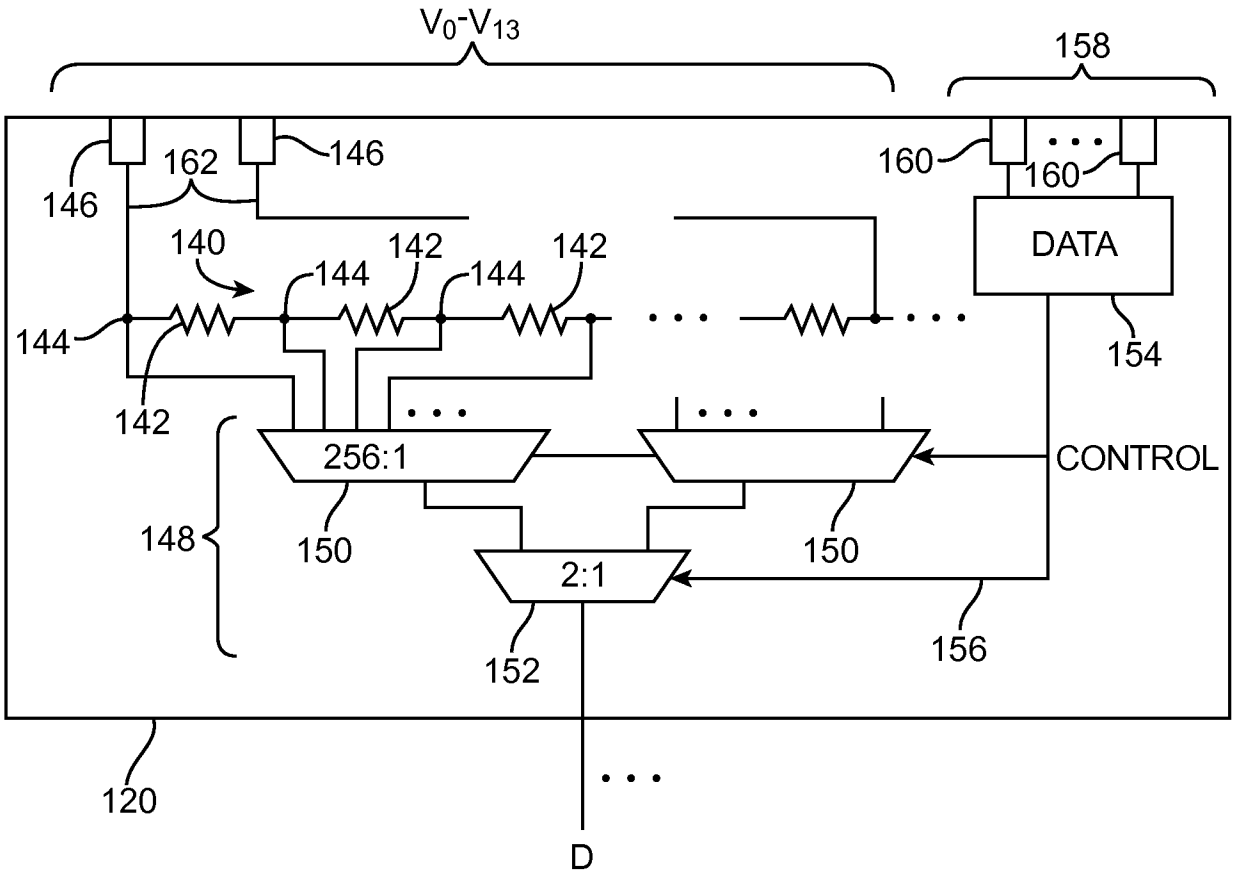
FIG. 9 is a circuit diagram of an illustrative column driver circuit in accordance with an embodiment of the present invention.

FIG. 9 is a circuit diagram of an illustrative column driver integrated circuit. As shown in FIG. 9, column driver integrated circuit 120 may have a data port such as data port 158. Data port 158 may have one or more pins such a pins 160. Digital display data that is provided to data port 158 may be received by data circuit 154 and converted into control signals on path 156. The signals on path 156 may be used in controlling digital-to-analog multiplexer circuitry 148 and therefore the size of signals D on the data lines in the display.

Voltage supply 132 (FIG. 7) supplies reference voltages V0 . . . V13 to voltage supply input terminals (reference voltage input pins) such as pins 146. Voltage divider circuitry 140 includes a chain of resistors 142 separated by nodes 144. A subset of nodes 144 (sometimes referred to as voltage reference nodes) are coupled to respective voltage reference input pins 146 by respective paths 162. Paths 162 distribute reference voltages V0 . . . V13 to the nodes within the resistor chain of voltage divider circuitry 140. Resistors 142 have resistance values that are configured to implement desired step sizes ΔVp of FIG. 8 when the reference voltage nodes are supplied with appropriate reference voltages V0 . . . V13. Adjustments to the distributions of steps ΔVp that are produced by column driver 120 can be made by producing a custom integrated circuit to implement column driver circuitry 120 and/or by adjusting the reference voltages V0 . . . V13 that are produced by voltage supply 132. Adjustments to the ΔVp values are sometimes referred to as gamma adjustments, so reference voltages V0 . . . V13 are sometimes referred to as gamma voltages or gamma reference voltages.

When the reference voltage nodes within voltage divider 140 are powered by reference voltages V0 . . . V13 from pins 146, each reference node in voltage divider 140 will be maintained at a different respective voltage. Resistors 142 divide the reference voltages into smaller steps (i.e., each node 144 will have a voltage that differs by a given voltage step from the next node 144 in the resistor chain). Multiplexers such as multiplexers 150 in multiplexer circuitry 148 may be used to select desired voltages from nodes 144 between resistors 142 in voltage divider 140 in response to the digital display data received at port 158. The configuration of multiplexer circuitry 148 therefore controls the voltages driven onto data lines D.

Liquid crystal displays often use frame-to-frame polarity reversal schemes to avoid issues with ion movement that might otherwise arise if data line voltages of a single polarity were to be applied to the columns in pixel array 92. Consider, as an example, a situation in which Vcom is maintained at 4 volts. In a first frame, the value of the data line voltage on a data line D may have a value in the range of 4 volts (corresponding to black pixel data) to a voltage that is larger than Vcom such as 8 volts (corresponding to white pixel data). In a second frame, the value of the data line voltage may be provided with a reversed-polarity value having a value that is lies between a lower limit that is smaller than Vcom such as 0 volts (corresponding to white pixel data) to the Vcom voltage of 4 volts (corresponding to black pixel data).

Respective portions of voltage divider chain 140 may be used in providing voltages on nodes 144 to respective multiplexers 150. For example, an upper portion of voltage divider chain 140 may have 256 nodes 144 for supplying 256 different voltages ranging from 4 volts to 8 volts to a first multiplexer 150 and a lower portion of voltage divider chain 140 may have 256 nodes 144 for supplying 256 different voltages ranging from 0 volts to 4 volts to a second multiplexer 150. For example, the value of a data line voltage may be 1 volt (which is 3 volts below Vcom) in one frame and in a subsequent frame the value of the data line voltage may be 7 volts (which is 3 volts above Vcom). Although the polarity of the signal is reversed between frames, the brightness of the pixel data is unaffected (i.e., both the 1 volt signal and the 7 volt signal in this example may correspond to light gray pixel data).

Multiplexer circuitry such as multiplexer 152 of FIG. 9 may be used in applying data signals of alternating polarity to data lines D by alternating between routing the output of first multiplexer 150 to data line D and routing the output of the second multiplexer 150 to data line D.

With this type of scheme, multiplexers 150 are adjusted by signals on paths 156 and serve as digital-to-analog converter control circuitry that converts digital data from paths 156 into analog voltages by routing a selected one of nodes 144 to multiplexer 152. Multiplexer 152 may be used to implement polarity reversal by alternating between two different multiplexers 150, each of which produces output voltages in a different range (e.g., 0-Vcom or Vcom-8 volts in this example).

There may be multiple column driver integrated circuits 120 in display 14 and each column driver integrated circuit in display 14 may supply multiple outputs. For example, each column driver integrated circuit may have 1024 pairs of multiplexers 150, where each pair of multiplexers 150 is coupled to a respective one of 1024 data lines D for that column driver integrated circuit by a respective one of 1024 multiplexers 152 (as an example).

Data lines D are loaded with display pixel capacitances such as storage capacitors 102 of FIG. 6 and the capacitance associated with liquid crystal material 52' and electrode structures 106. Because data lines D are capacitively loaded in this way, there is a potential for relatively large column driver currents to be produced when using column driver circuitry 120 to provide display pixel array 92 with data to be displayed on display 14. Large column driver currents can lead to ground bounce and positive power supply droop effects, particularly in displays in which power supply lines for powering column driver integrated circuits 120 are implemented using display traces with non-negligible resistance.

To minimize start-up and shut-down current surges associated with powering up and powering down column driver circuitry 120 (i.e., to provide display 14 with soft display power state transitions in which power supply current surges are minimized), voltage supply 132 can be configured so that the reference voltages V0 . . . V13 that are provided to column driver circuitry 120 are maintained at transitional column driver reference voltage values that minimize column driver power supply transients during start-up and shut-down operations.

During normal operation of the display, a set of normal column driver reference voltages V0 . . . V13 can be applied to allow images to be displayed. But by applying one or more transitional column driver voltage divider reference voltages to the column driver input pins during power state transitions (i.e., power-up transitions and power-down transitions), current surges on the positive power supply and ground rails for the column driver circuitry due to current surges on the data lines can be avoided and soft power transitions (i.e., soft power-up transitions and soft power-down transitions) can be achieved. As an example, voltages V0 . . . V13 may be maintained at zero volts during start-up operations, may be maintained at a low value near zero volts during start-up operations, or may be maintained at a black or nearly black value (e.g., at a value that is equal to or nearly equal to voltage Vcom) during start-up operations.

Figure 10:
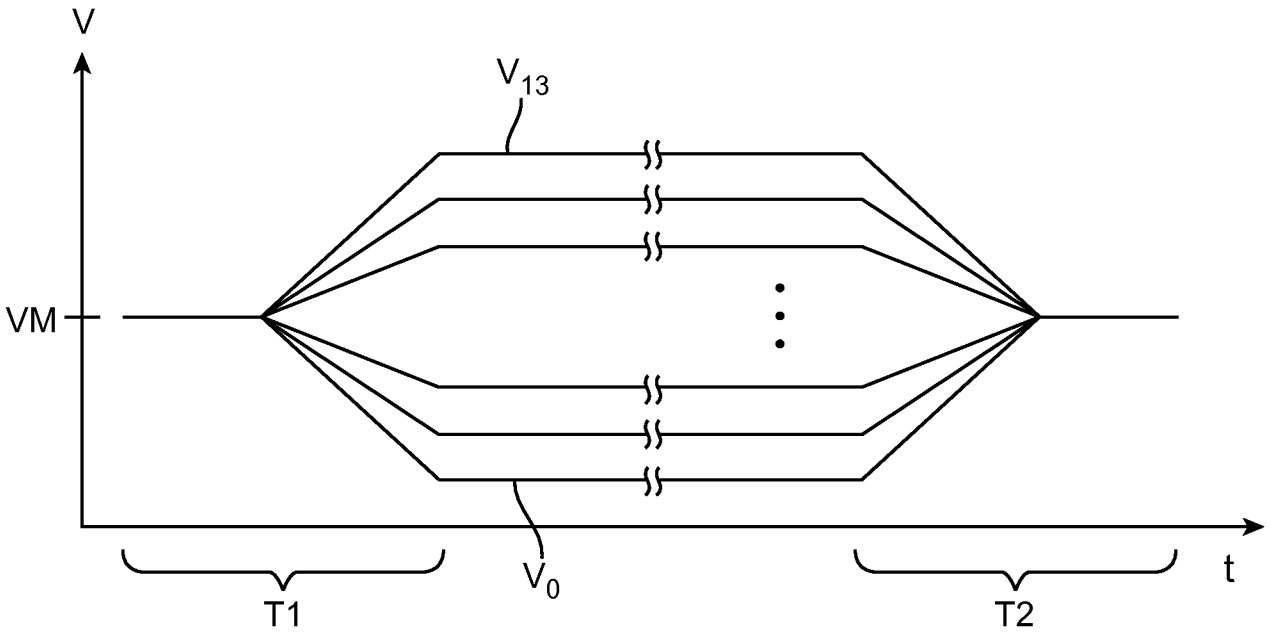
FIG. 10 is graph showing how column driver voltage divider reference voltages may be controlled as a function of time to provide column driver circuitry with soft-start and soft-shutdown capabilities in accordance with an embodiment of the present invention.

As shown in FIG. 10, for example, voltages V0 . . . V13 may be maintained at a transitional voltage such as a voltage value of VM (e.g., Vcom or a value near Vcom) during start-up period T1. After the data that is received on data port 158 by data circuit 154 of FIG. 9 has stabilized and display 14 is ready for normal operation in displaying images to a user, voltage supply 132 can take voltages V0 . . . V13 to appropriate normal values (e.g., by ramping voltages V0-V13 to values ranging from about 0 volts for V0 to about 8 volts for V13), as shown in FIG. 10.

During shut-down operations in period T2, voltage supply 132 FIG. 10 can likewise ramp down voltages V0 . . . V13 to voltage VM and maintain voltages V0 . . . V13 at a fixed zero, low, or black level until shut-down operations are complete. The ramp-up and ramp-down processes of FIG. 10 may be controlled by producing a series of ramped reference voltages as a function of time or voltage ramping may result from switching voltage supply 132 between a first mode of operation in which its output is fixed (e.g., at Vcom for each output pin) and a second mode of operation in which its output pins produce a set of normal reference voltages V0 . . . V13.

Figure 11:
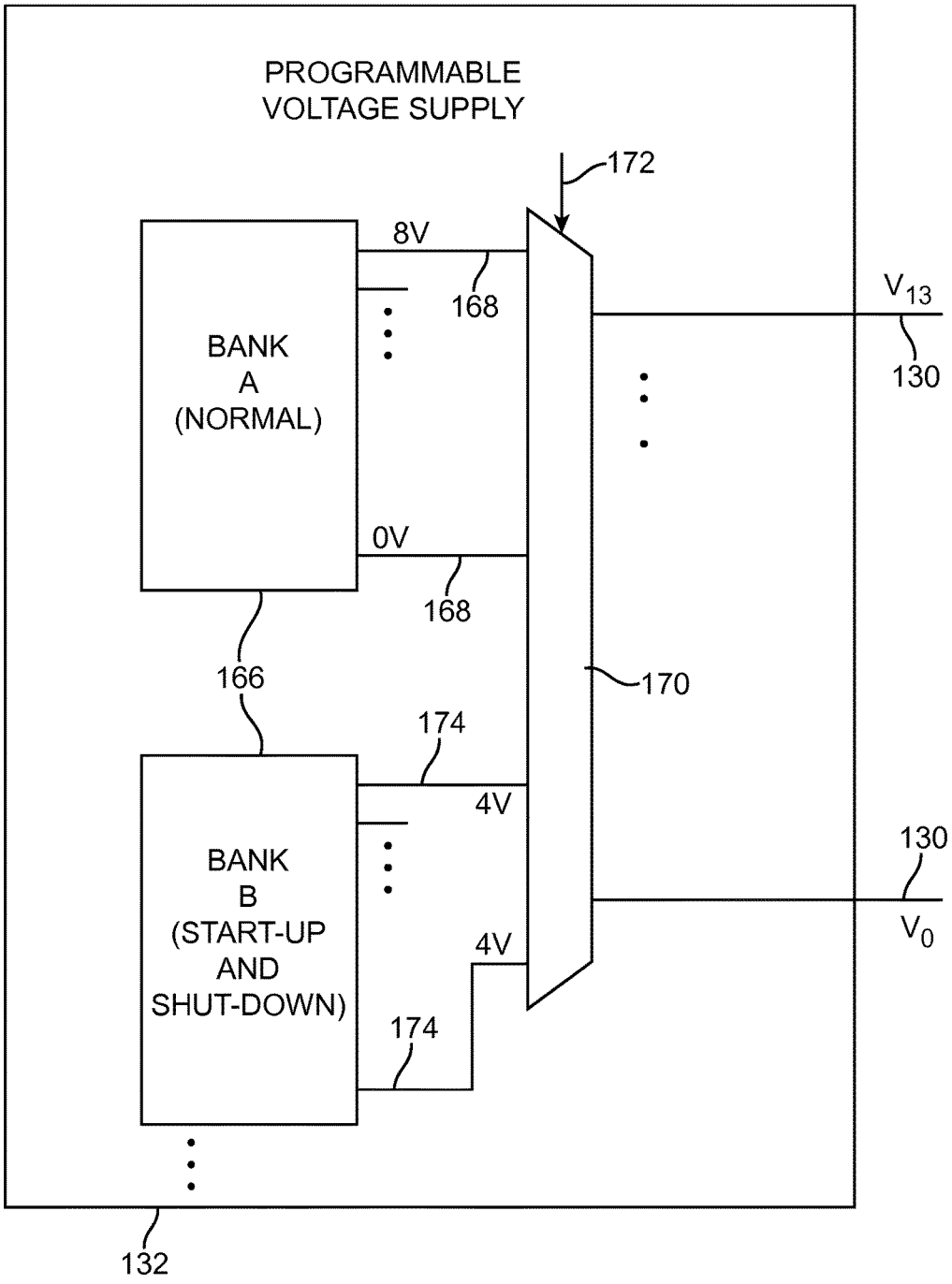
FIG. 11 is a diagram of an illustrative programmable voltage power supply circuit that may be used in providing reference voltages that vary as a function of time to implement soft-start and soft-shutdown functionality in a display in accordance with an embodiment of the present invention.

Voltage supply 132 may include any suitable circuitry for supplying desired output voltages V0 . . . V13 as a function of time. With one illustrative configuration, which is shown in FIG. 11, voltage supply 132 is implemented using a programmable voltage supply circuit. Programmable voltage supply 132 may be controlled using internal control circuitry and/or control signals from external circuits such as control signals on control paths 136 of FIG. 7. Control signals may, for example, be supplied to circuitry such as multiplexer circuitry 170 (e.g., at control input 172).

Programmable voltage supply 132 of FIG. 11 may have two or more banks 166 of voltage regulator circuitry each of which produces a corresponding set of output voltages. There may be, for example, a first bank of voltage regulator circuitry such as circuit bank A of FIG. 11 that produces voltages ranging from 0 volts to 8 volts on 14 corresponding output lines 168 and a second bank of voltage regulator circuitry such as circuit bank B of FIG. 11 that produces a Vcom voltage level of 4 volts on each of its 14 output lines 174. Control signal 172 on multiplexer 170 may be used to route the start-up voltages (4 volts in this example) from lines 174 to output lines 130 during start-up operations. Following start-up operations, control signal 172 on multiplexer 170 may be used to route normal column driver voltage divider reference voltages 0 . . . 8 V from lines 168 to respective outputs 130. With this type of arrangement, reference voltages V0 . . . V13 will initially be maintained at a shared transitional value of 4 volts by bank B to prevent excessive in-rush currents to column driver circuitry 120 while start-up operations are being performed after which bank A may be switched into use to allow display 14 to operate normally. During normal operation, the pattern of column driver voltage divider reference voltages V0 . . . V13 that is provided from programmable voltage supply 132 to column driver circuitry 120 will ensure that display 14 is able to satisfactorily display images on display pixel array 92. When it is desired to shut-down display 14, bank B (or another bank) may be switched into use to prevent current surges.

Figure 12:
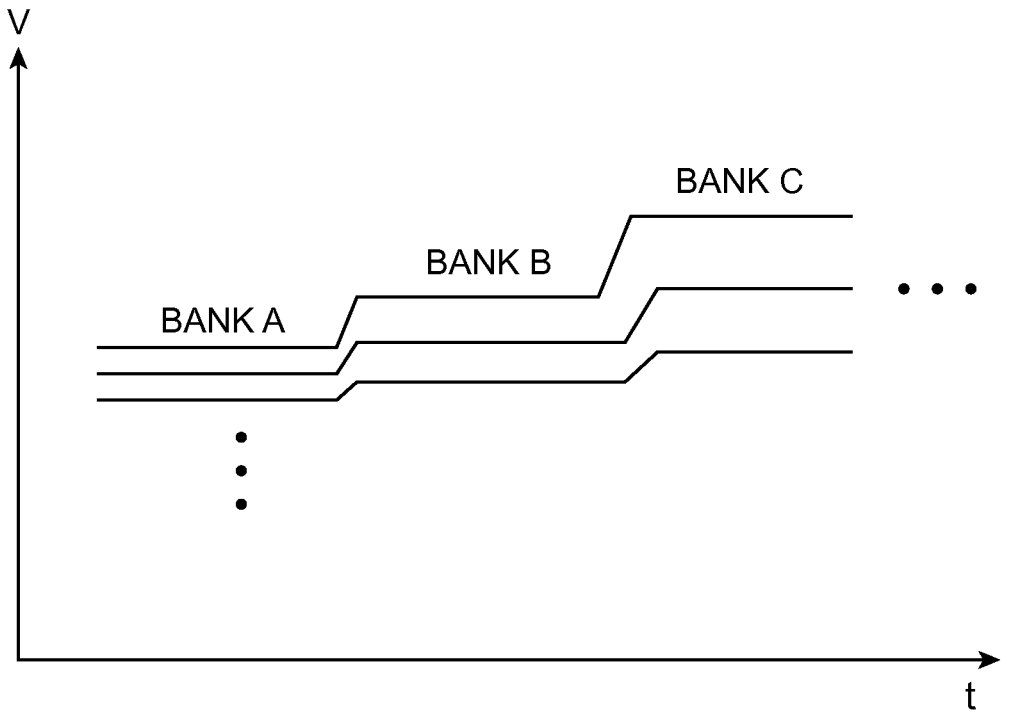
FIG. 12 is a graph showing how the output of a column driver voltage supply may vary as a function of time by switching between multiple voltage supply circuit banks within the voltage supply as a function of time in accordance with an embodiment of the present invention.

If desired, more than two banks of voltage regulator circuitry may be provided in programmable voltage supply 132 of FIG. 11. This allows voltages V0 . . . V13 to be incremented (and decremented) in a series of steps, each associated with a respective bank. As shown in FIG. 12, for example, voltage supply 132 may take V0 . . . V13 to a first set of voltages by adjusting multiplexer 170 to switch the outputs of bank A into use, by taking V0 . . . V13 to a second set of voltages by adjusting multiplexer 170 to switch the outputs of bank B into use, by taking voltages V0 . . . V13 to a third set of voltages by adjusting multiplexer 170 to switch the outputs of bank C into use, etc. By using switching circuitry such as multiplexer 172 or other adjustable circuitry in voltage supply 132 to control the values of V0 . . . V13 as a function of time, controlled voltage increases (e.g., controlled reference voltage ramp-ups for power-on scenarios) and controlled voltage decreases (e.g., controlled reference voltage ramp-downs for power-down scenarios) can be implemented. Current surges can be minimized, regardless of the values of the digital data that is being supplied to data circuit 154 during the power-up or power-down period.

Figure 13:
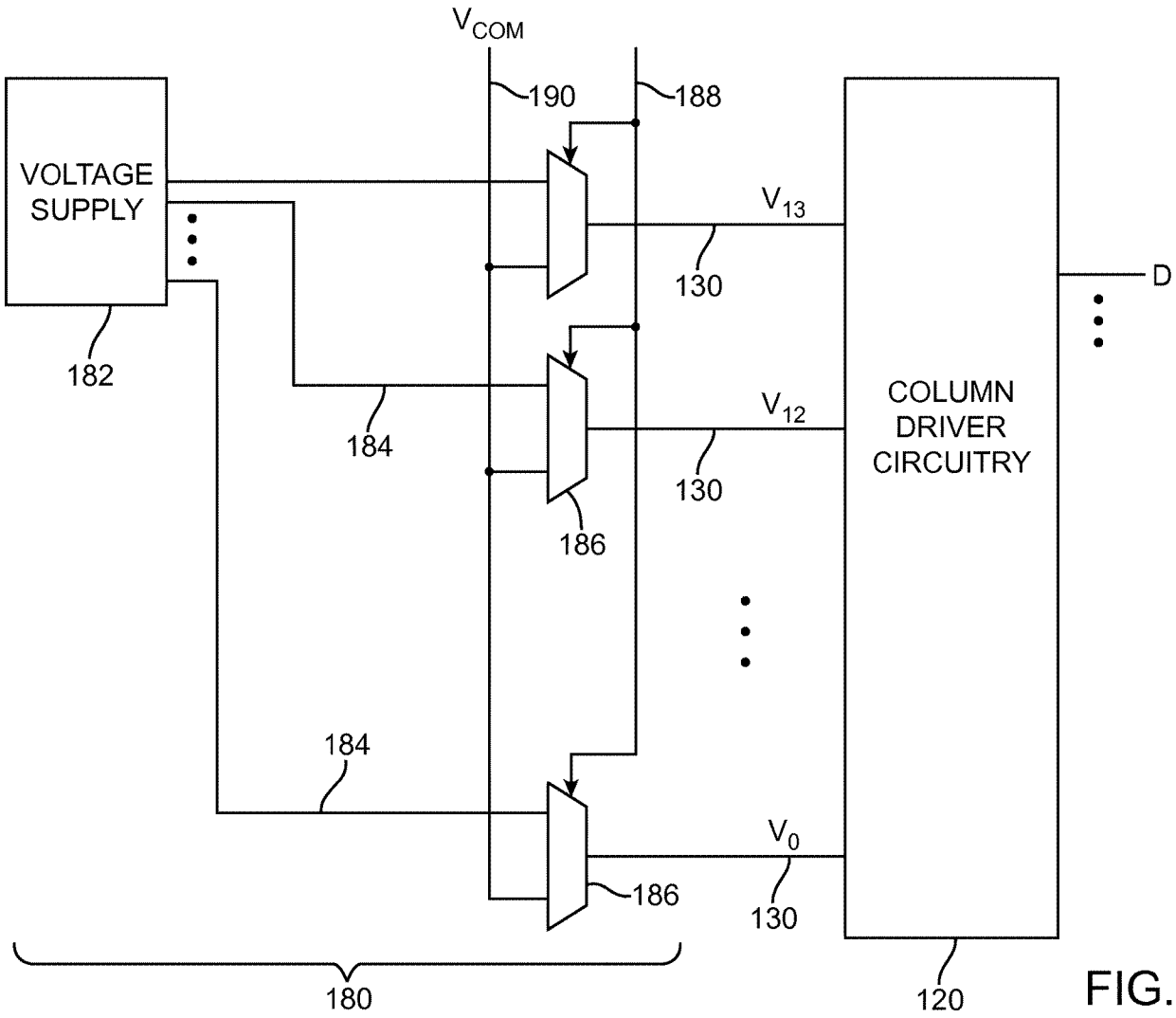
FIG. 13 is a circuit diagram of a circuit of the type that may be used in switching a voltage such as a common electrode voltage into use as a reference voltage during display start-up and shut-down operations in accordance with an embodiment of the present invention.

In the illustrative voltage supply of FIG. 13, voltage supply circuit 182 produces a range of voltages (e.g., 0 volts to 8 volts or other suitable voltages) on output lines 184. Multiplexers 186 each have two inputs and an output. The first input of each multiplexer 186 receives a respective one of lines 184. The second input of each multiplexer 186 receives common electrode voltage Vcom (or other suitable voltage) from line 190. Multiplexer control signal 188 is used to adjust whether the outputs of supply 182 or the Vcom signal on line 190 will be switched to the output of multiplexers 186. This allows circuitry 180 to serve as an adjustable voltage supply. When multiplexer circuitry 186 is placed in a first state by control signal 188, voltages V0 . . . V13 are all set to a shared fixed voltage value such as common electrode Vcom to reduce current surges in column driver circuitry 120. When multiplexer 186 is placed in a second state by control signal 188, voltages V0 . . . V13 are all set to the normal range of column driver input voltages (e.g., 0 volts to 8 volts) for operating column driver circuitry 120.

Figure 14:
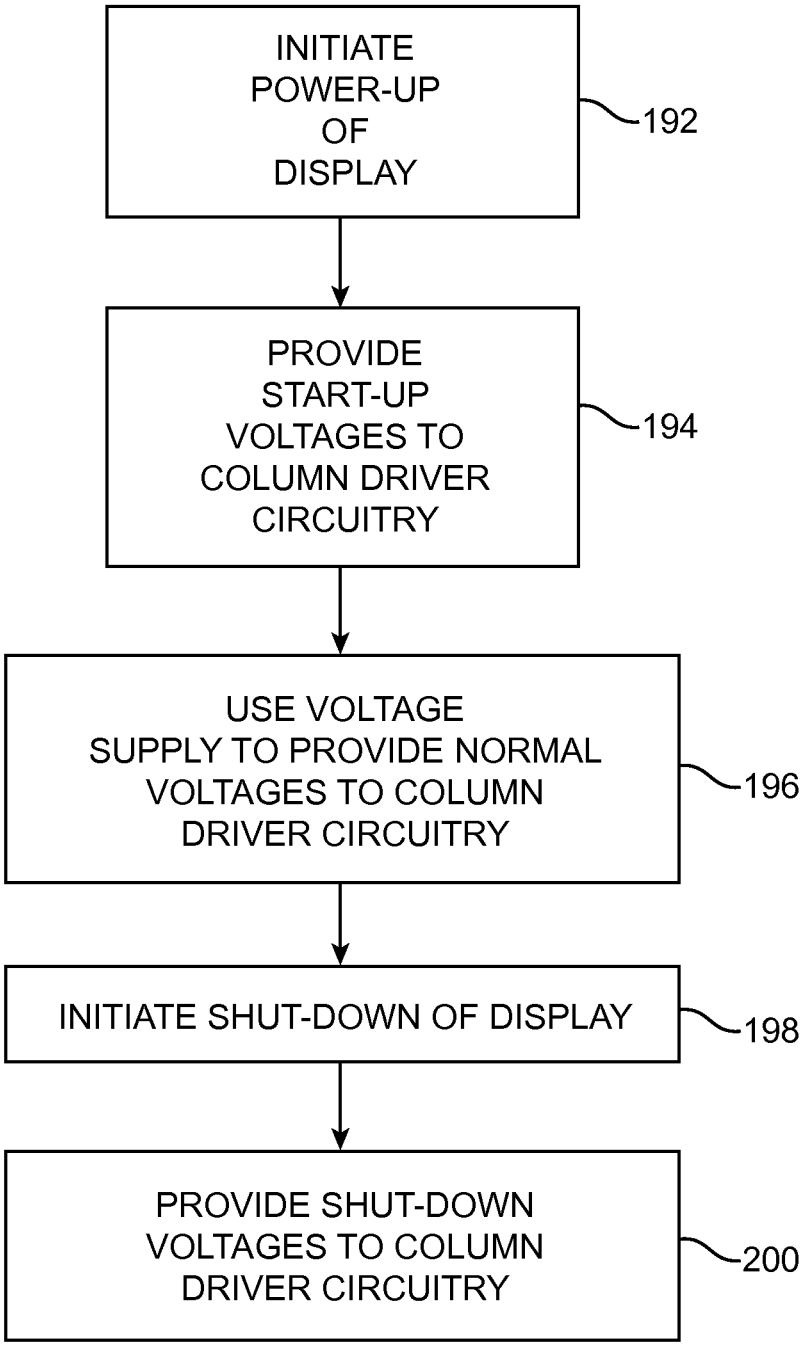
FIG. 14 is a flow chart of illustrative steps involved in operating a display in accordance with an embodiment of the present invention.

FIG. 14 is a flow chart of illustrative steps involved in using voltage supply 132 to provide column driver circuitry 120 with dynamically adjusted column driver voltage divider reference voltages (column driver input voltages) to help reduce current surges during power-up and/or power-down operations.

At step 192, control circuitry 122 or other circuitry in device 10 may be used to initiate a display power-up operation. For example, control circuitry 122 may detect that a user has pressed a button or has otherwise supplied input directing device 10 to turn on display 14.

At step 194, voltage supply 132 may supply column driver voltage divider reference voltages V0 . . . V13 to column driver circuitry 120 over path 130. In providing the column driver reference voltages to column driver circuitry 120, voltage supply 132 preferably controls the magnitude of the voltages V0 . . . V13 to limit current surges of the type that might otherwise be experienced when turning on column driver circuitry 120 abruptly. For example, voltage supply 132 may maintain voltages V0 . . . V13 at a fixed voltage (e.g., Vcom or other fixed voltage) for a period of time, voltage supply 132 may ramp up voltages V0 . . . V13 to their full values over a period of time to provide a gradual increase in voltage to each of inputs 146 of FIG. 9, voltage supply 132 may use two or more voltage regulator circuit banks to produce voltages V0 . . . V13 that increase in a stepwise fashion towards a set of normal column driver input voltages as described in connection with FIG. 12, or voltage supply 132 may otherwise provide transitional column driver voltage divider reference voltages V0 . . . V13 to column driver circuitry 120.

At step 196, voltage supply 132 may provide column driver circuitry 120 with a normal set of column driver voltage divider reference voltages (e.g., reference voltages ranging from 0 volts for V0 to 8 volts for V13, etc.). Display 14 can be operated normally. Column driver circuitry 120 will use the column driver reference voltages V0 . . . V13 in converting digital display data on port 158 into analog voltages on data lines D in array 92.

At step 198, control circuitry 122 or other circuitry in device 10 may be used to initiate a display power-down operation. For example, control circuitry 122 may detect that a user has pressed a button, interacted with a touch sensor array on display 14, or has otherwise supplied input directing device 10 to turn off display 14.

At step 200, voltage supply 132 may supply column driver voltage divider reference voltages V0 . . . V13 to column driver circuitry 120 over path 130 to implement a soft power down operation. In providing the column driver voltage divider reference voltages to column driver circuitry 120, voltage supply 132 preferably controls the magnitude of the voltages V0 . . . V13 to limit current surges. For example, voltage supply 132 may take voltages V0 . . . V13 to a fixed voltage (e.g., Vcom or other fixed voltage) for a period of time, voltage supply 132 may ramp down voltages V0 . . . V13 from their full values over a period of time to provide a gradual decrease in voltage to each of inputs 146 of FIG. 9, voltage supply 132 may use two or more voltage regulator circuit banks to produce voltages V0 . . . V13 that decrease in a stepwise fashion from a set of normal column driver input voltages to lower values and/or a common fixed value such as Vcom, or voltage supply 132 may otherwise provide time-varying column driver voltage divider reference voltages V0 . . . V13 to column driver circuitry 120 that reduce current surges during power-down operations.

The foregoing is merely illustrative of the principles of this invention and various modifications can be made by those skilled in the art without departing from the scope and spirit of the invention.

What is claimed is:

1. A method of operating an electronic device display that has an array of display pixels configured to receive data on data lines from column driver circuitry, the method comprising:

with a voltage supply, supplying transitional voltages to signal lines, wherein each of the signal lines is coupled to a corresponding reference voltage input pin in the column driver circuitry and supplies a given one of the transitional voltages to its corresponding reference voltage input pin during power state transitions for the column driver circuitry in which the column driver circuitry transitions between a powered-down state and a powered-on state, wherein the voltage supply that supplies the transitional voltages is external to the column driver circuitry; and with the voltage supply, supplying normal column driver reference voltages to the signal lines, wherein each of the signal lines supplies a given one of the normal column driver reference voltages that is different than the given one of the transitional voltages to its corresponding reference voltage input pin during normal operation of the column driver circuitry in which the column driver circuitry is in the powered-on state.

2. The method defined in claim 1 wherein supplying the power state transitions include a power-on transition in which the column driver circuitry is powered on and wherein supplying the transitional voltages comprises supplying a shared fixed voltage to each of the reference voltage input pins during the power-on transition.

3. The method defined in claim 2 wherein the display pixels are supplied with a common electrode voltage using a common electrode during normal operation of the column driver circuitry and wherein supplying the shared fixed voltage comprises applying the common electrode voltage to each of the reference voltage input pins during the power-on transition.

4. The method defined in claim 3 wherein applying the common electrode voltage comprises adjusting multiplexer circuitry to route the common electrode voltage from a common electrode voltage line to each of the reference voltage input pins.

5. The method defined in claim 4 wherein supplying the normal column driver reference voltages to the reference voltage input pins during normal operation of the column driver circuitry comprises adjusting the multiplexer circuitry to couple outputs of the voltage supply to the reference voltage input pins.

6. The method defined in claim 1 wherein the power state transitions include a power-on transition in which the column driver circuitry is powered on and wherein supplying the transitional voltages comprises supplying time-varying voltages to the reference voltage input pins during the power-on transition.

7. The method defined in claim 1 wherein the voltage supply includes first and second circuit banks each having a plurality of respective outputs that are selectively coupled to the reference voltage input pins and wherein supplying the transitional voltages comprises supplying the transitional voltages with the first circuit bank.

8. The method defined in claim 7 wherein supplying the normal column driver reference voltages to the reference voltage input pins comprises supplying the normal column driver reference voltages to the reference voltage input pins during normal operation of the column driver circuitry using the second circuit bank.

9. The method defined in claim 1 further comprising:

using multiple banks of circuitry in the voltage supply to supply the transitional voltages and the normal column driver reference voltages.

10. Apparatus, comprising:

an array of display pixels organized in rows and columns;

gate lines and data lines coupled to the display pixels to provide signals to the display pixels, wherein each of the gate lines runs along a respective row of the display pixels and wherein each of the data lines runs along a respective column of the display pixels;

column driver circuitry having a plurality of outputs each coupled to a respective one of the data lines, wherein the column driver circuitry has voltage divider circuitry with reference voltage nodes and has a plurality of reference voltage input terminals respectively coupled to the reference voltage nodes and wherein the column driver circuitry receives digital data and is configured to use the voltage divider circuitry to supply data signals to the data lines based on the digital data; and a voltage supply that is configured to provide a set of normal column driver voltage divider reference voltages to the column driver circuitry so that each respective normal column driver voltage divider reference voltage is supplied to a respective one of the reference voltage input terminals during normal operation of the column driver circuitry in displaying images and is configured to provide transitional column driver voltage divider reference voltages to each of the reference voltage input terminals during power state transitions for the column driver circuitry so that each respective one of the reference voltage input terminals receives a respective one of the transitional column driver voltage divider reference voltages, wherein the respective transitional column driver voltage divider reference voltage and the respective normal column driver voltage divider reference voltage are different for each respective one of the reference voltage input terminals, wherein the voltage supply comprises multiplexer circuitry that provides either the normal column driver voltage divider reference voltages or the transitional column driver voltage divider reference voltages to the plurality of reference voltage input terminals.

11. The apparatus defined in claim 10 wherein the voltage supply comprises a programmable voltage supply.

12. The apparatus defined in claim 10 wherein the voltage supply includes first and second circuit banks, wherein the first circuit bank is configured to supply the set of normal column driver voltage divider reference voltages to the column driver circuitry.

13. The apparatus defined in claim 12 wherein the second circuit bank is configured to supply the transitional column driver voltage divider reference voltages to the reference voltage input terminals during power state transitions for the column driver circuitry.

14. The apparatus defined in claim 10 wherein the transitional column driver voltage divider reference voltages comprise a plurality of different time-varying voltages and wherein the voltage supply is configured to supply each of the plurality of different time-varying voltages to a respective one of the reference voltage input terminals during a power-on transition for the column driver circuitry.

15. The apparatus defined in claim 10 wherein the array of display pixels comprises a common electrode that is provided with a common electrode voltage during normal operation of the column driver circuitry and wherein the voltage supply is configured to provide the common electrode voltage to each of the reference voltage input terminals during a power-on transition for the column driver circuitry.

16. The apparatus defined in claim 10 wherein the array of display pixels comprises liquid crystal display pixels.

17. A method of powering column driver circuitry that provides data line signals to data lines in a display that has an array of display pixels that are controlled using the data lines, comprising:

with a voltage supply, providing transitional column driver voltage divider reference voltages to input pins in the column driver circuitry during power-up operations for the column driver circuitry, wherein providing the transitional column driver voltage divider reference voltages comprises increasing the transitional column driver voltage divider reference voltage received at a given one of the input pins from a first column driver voltage divider reference voltage to a second column driver voltage divider reference voltage during the power-up operations; and with the voltage supply, providing different respective normal column driver voltage divider reference voltages to each of the input pins in the column driver circuitry during normal operation of the column driver circuitry to display images on the display, wherein the normal column driver voltage divider reference voltage received at the given one of the input pins is different from the first column driver voltage divider reference voltage and the second column driver voltage divider reference voltage.

18. The method defined in claim 17 wherein the display pixels comprise liquid crystal display pixels sharing a common electrode, the method further comprising:

supplying a common electrode voltage to the common electrode during normal operation of the column driver circuitry to display images on the display.

19. The method defined in claim 18 further comprising:

with the voltage supply, supplying the common electrode voltage to the input pins during the power-up operations.

20. The method defined in claim 17 further comprising:

with the voltage supply, supplying a fixed voltage to the input pins during the power-up operations.

21. The method defined in claim 17 further comprising:

with the voltage supply, supplying a plurality of respective time-varying voltages to the input pins during the power-up operations, wherein the time-varying voltages differ from the normal column driver voltage divider reference voltages.

* * * * *